US005333931A

United States Patent [19]

Weddendorf

[11] Patent Number: 5,333,931

[45] Date of Patent: Aug. 2, 1994

[54] PORTABLE SEAT LIFT

[75] Inventor: Bruce Weddendorf, Decatur, Ala.

[73] Assignee: The United States of America as represented by the Administrator, National Aeronautics and Space Administration, Washington, D.C.

[21] Appl. No.: 970,203

[22] Filed: Nov. 2, 1992

[51] Int. Cl.[5] ..... A47L 1/00

[52] U.S. Cl. ..... 297/334; 247/330; 247/DIG. 10

[58] Field of Search ..... 297/DIG. 10, 313, 334, 297/335, 330, 331; 5/81.1; 254/124

[56] References Cited

U.S. PATENT DOCUMENTS

| | | | |
|---|---|---|---|
| 239,862 | 4/1881 | Shupe | 297/334 |
| 3,250,569 | 5/1966 | Gaffney | 297/DIG. 10 |
| 3,479,086 | 11/1969 | Sheridan | 297/DIG. 10 |
| 3,848,845 | 11/1974 | Bogart | 297/DIG. 10 |
| 4,581,778 | 4/1986 | Pontoppidan | 297/DIG. 10 |
| 4,838,612 | 6/1989 | Cross | 297/DIG. 10 |
| 5,082,327 | 1/1992 | Crisp | 297/DIG. 10 |

FOREIGN PATENT DOCUMENTS

| | | | |
|---|---|---|---|
| 1578395 | 11/1980 | United Kingdom | 297/DIG. 10 |

*Primary Examiner*—Flemming Saether
*Attorney, Agent, or Firm*—Jerry L. Seemann

[57] ABSTRACT

A portable seat lift that can help individuals either (1) lower themselves to a sitting position or (2) raise themselves to a standing position. The portable seat lift consists of a seat mounted on a base with two levers, which are powered by a drive unit.

7 Claims, 4 Drawing Sheets

PORTABLE SEAT LIFT

The invention described in this patent was made by an employee of the United States Government and may be manufactured and used by or for the Government for governmental purposes without the payment of any royalties.

BACKGROUND OF THE INVENTION

1. Field of the Invention

In general, this invention pertains to devices that assist physically impaired individuals. Specifically, this invention pertains to devices that assist individuals in going from a sitting position to a standing position and also from a standing position to a sitting position.

2. Background Information

There are basically two types of devices already available for helping a physically impaired individual go from a sitting position to a standing position and vice versa. The first type is a complete chair that has a mechanized seat for helping a person up or down. The second type is a spring-assisted portable seat that can simply be placed on the seat of another chair.

The first type, while being totally sufficient with respect to sitting and standing assistance, has the disadvantage of not being readily portable for the individual who requires help with sitting and standing in many places.

Typical construction of the second type of device consists of a seat that is hinged to a base along the front edge of the device. When this device is in the down (sitting) position, a spring is compressed between the base and the seat. To raise the seat to a standing position, the spring is allowed to push the seat away from the base in a book-like manner. A latch is usually provided to lock the seat in the down position. This second type, while being portable, has several drawbacks. First, the spring has to be carefully matched to the user's body weight so that the person is able to fully compress the spring by sitting on the device. Because of the nature of a spring, this device can never provide all of the force necessary within the operating range of the device to take a person to a sitting position or return them to a standing position. Second, this device fails to provide the proper range of motion that is needed to comfortably sit or stand. This is due to book-like hinge design which does not provide any lifting capability to the front of the seat connected to the hinge. A third disadvantage is that this device does not give any flexibility to the user between the open (standing) position and the closed (sitting) position. For example, once the user starts to stand, they must complete the move or return to a sitting position. Finally, once the user is standing, there is no convenient way to close the device in order to transport it short of having someone sit on the device again to close it.

SUMMARY OF THE INVENTION

This invention is a portable seat lift that can help physically impaired individuals either (1) lower themselves to a sitting position or (2) raise themselves to a standing position. This seat lift consists of a seat mounted with two levers to a base. The levers are powered by a drive unit that can completely lift the weight of a user without any assistance from the user. When the drive unit actuates the two levers, both the front and back of the seat are raised in a manner that coincides with how the backs of the thighs normally approach or leave a chair when a person sits or stands, respectively. As a result, the physically impaired person can sit or stand with more ease and much more naturally.

DESCRIPTION OF THE PREFERRED EMBODIMENT

Figure 1:
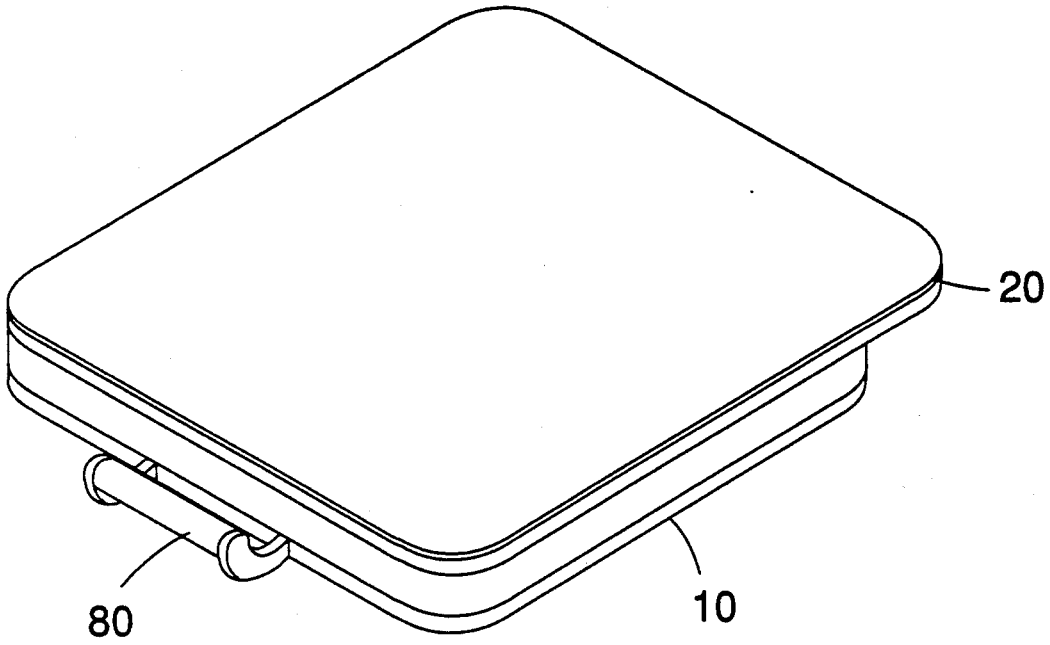
FIG. 1 is a perspective view showing the portable seat lift in the closed (sitting) position.
Figure 2:
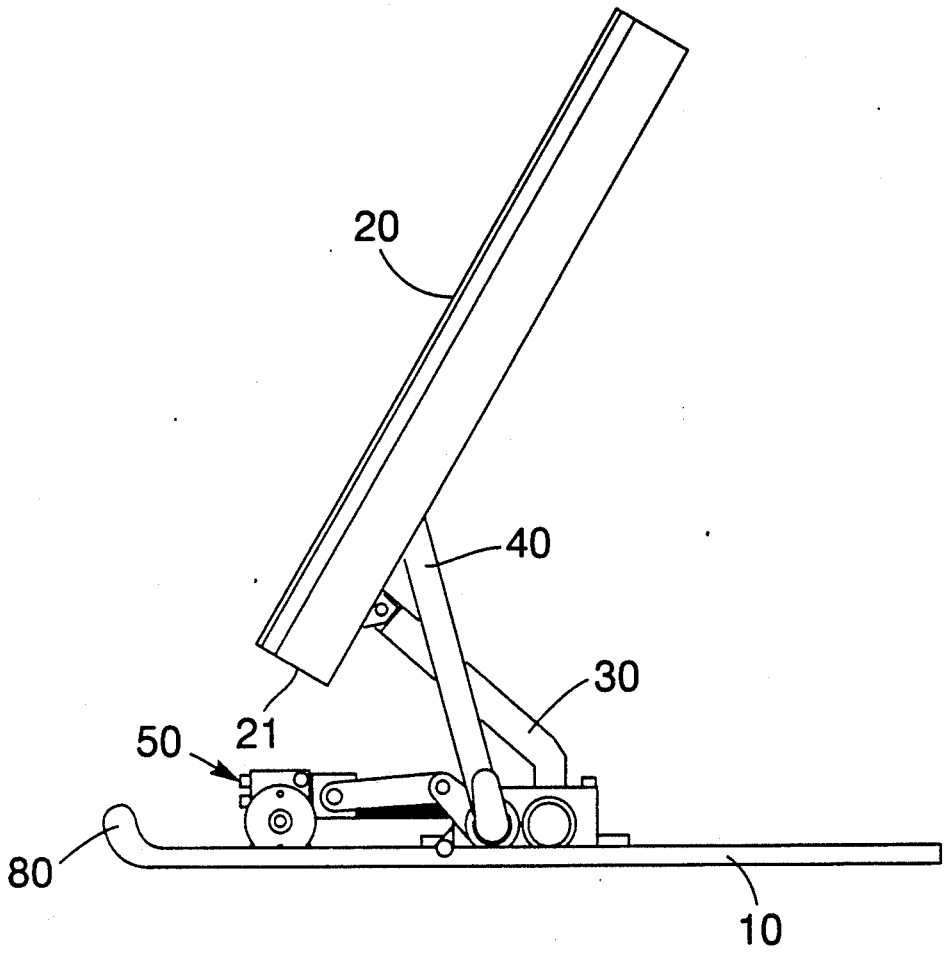
FIG. 2 is a side view showing the portable seat lift in the open (standing) position.
Figure 3:
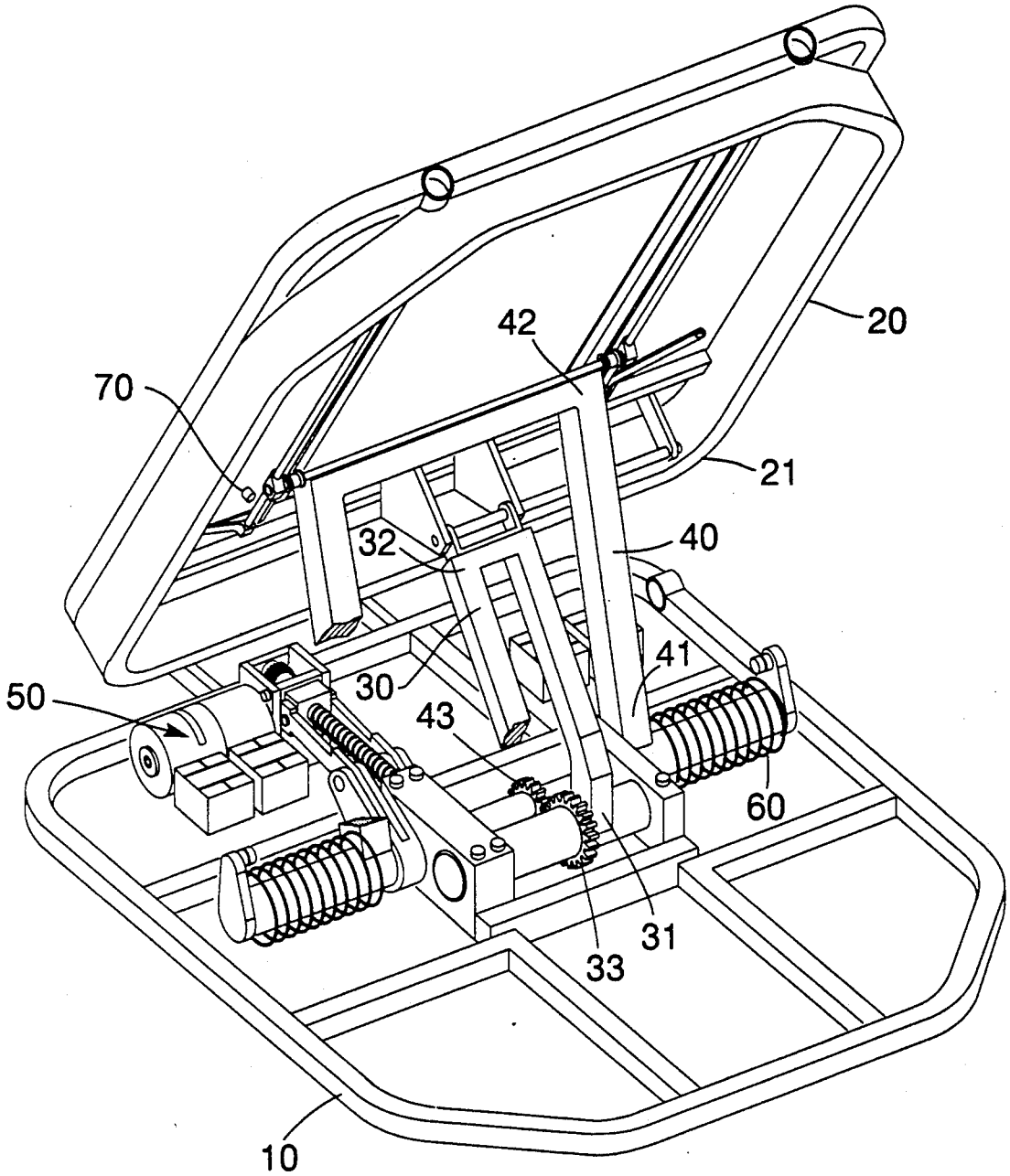
FIG. 3 is a perspective view showing the portable seat lift in the open (standing) position.

Referring to FIGS. 1, 2, and 3, a preferred embodiment of this invention comprises a base (10) and a seat (20) connected to each other with two levers, a front lever (30) and a back lever (40). The seat (20) has a front side (21). The front lever (30) has a base end (31) and a seat end (32). The base end (31) of the front lever (30) is rotationally mounted to the base (10) and the seat end (32) of the front lever (30) is rotationally mounted to the front side (21) of the seat (20). The back lever (40) also has a base end (41) and a seat end (42). The base end (41) of the back lever (40) is rotationally mounted to the base (10) and the seat end (42) of the back lever (40) is slidably mounted to the seat (20). A means for proportionately rotating the front lever (30) with the back lever (40) provides for movement of the seat (20) relative to the base (10).

Figure 4:
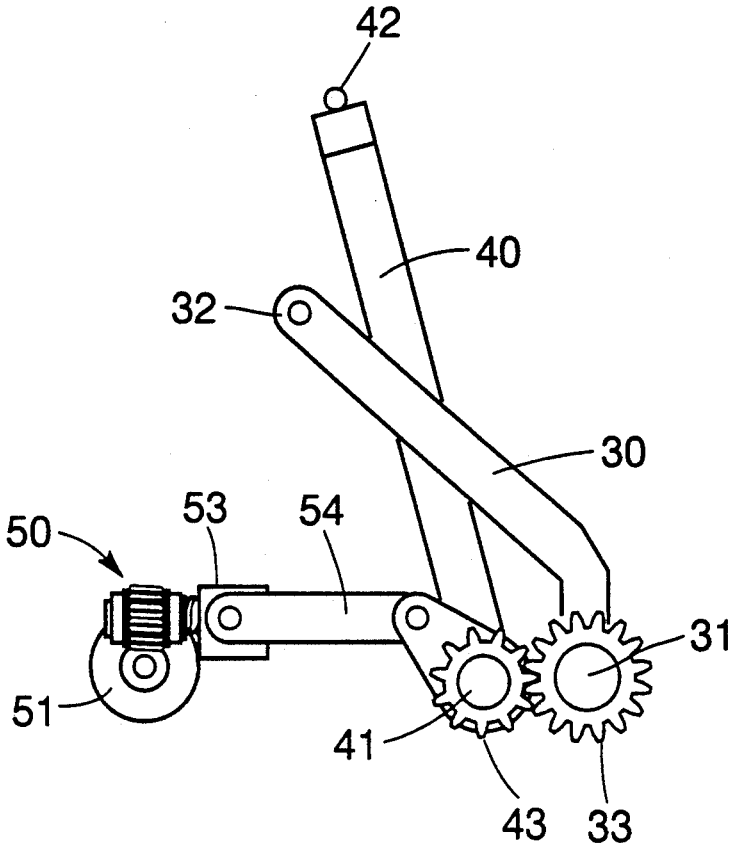
FIG. 4 is a side view showing the two levers of the portable seat lift in the open (standing) position.
Figure 5:
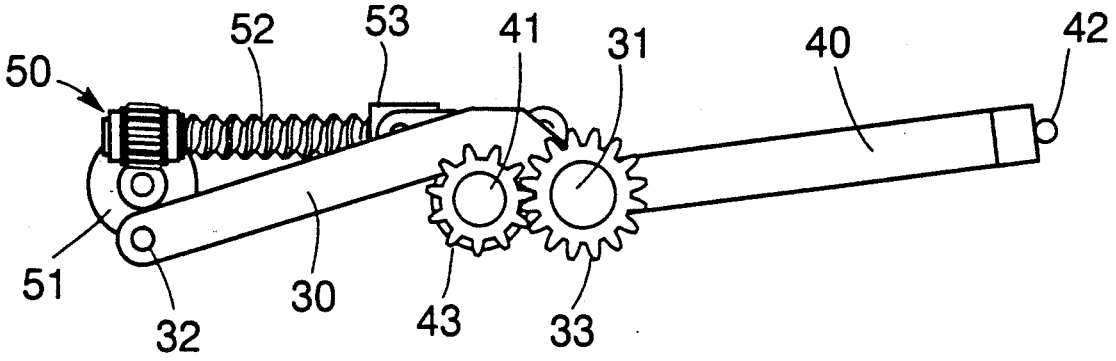
FIG. 5 is a side view showing the two levers of the portable seat lift in the closed (sitting) position.

Although there are several mechanisms capable of proportionately rotating the front lever (30) with the back lever (40), a preferred mechanism is shown in FIGS. 4 and 5. In these figures, a first gear (33) is concentrically mounted to the base end (31) of the front lever (30). In addition, a second gear (43) is concentrically mounted on the base end (41) of the back lever (40). By meshing the first gear (33) with the second gear (43), a drive unit (50) connected to either the front lever (30) or the back lever (40) can operate the two levers together in a synchronized fashion. The drive unit (50) shown in FIGS. 4 and 5 consists of (a) a battery-powered, switched motor (51) capable of operating in two directions, (b) a threaded rod (52), (c) a carrier (53), and (d) a linkage (54). The shaft of the motor (51) is connected to the threaded rod (52), the threaded rod (52) screws into the carrier (53), and the carrier (53) is pivotally connected to the linkage (54). The motor (51) turns the threaded rod (52), the threaded rod (52) translates the carrier (53), and the carrier (53) moves the linkage (54). By connecting the linkage (54) to either the front lever (30) or the back lever (40), the seat (20) may be raised or lowered by operating the motor (51).

To reduce the amount of power required to lift the seat (20), a spring (60) having a bias may be mounted between either the front lever (30) or the back lever (40) and the base (10). In FIG. 3, the spring ( 60 ) is shown mounted between the back lever (40) and the base (10). Also shown in FIG. 3 is a limit switch (70) that may be used to automatically stop the drive unit (50) when the seat (20) reaches a certain position. In addition, a handle (80) may be attached to either the base (10) or the seat (20) for carrying the portable seat lift between locations.

In FIGS. 1 and 2, the handle (80) is attached to the base (10).

The use of the portable seat lift is straight forward. For assistance in sitting, a person simply places the backs of their thighs on the open seat lift and operates the switched motor to be lowered into a sitting position. For assistance in standing, a person simply operates the switched motor from a sitting position in order to be raised to a standing position.

What is claimed is:

1. A seat lift, comprising:

a base;

a seat having a front side;

a front lever being a single element having a base end and a seat end, said base end of said front lever is rotationally mounted directly to said base at a fixed position and said seat end of said front lever is rotationally mounted to said front side of said seat;

a back lever having a base end and a seat end, said base end of said back lever is rotationally mounted to said base and said seat end of said back lever is slidably mounted to said seat; and a means for proportionally rotating said front lever with said back lever.

2. A seat lift as recited in claim 1, wherein said means for proportionately rotating said front lever with said back lever, comprises:

a first gear concentrically mounted on said base end of said front lever;

a second gear concentrically mounted on said base end of said back lever, said second gear being meshed with said first gear; and a drive unit, said drive unit being capable of rotating said front lever with said back lever.

3. A seat lift as recited in claim 2, wherein said drive unit, comprises:

a battery-powered, switched motor capable of operating in two directions;

a threaded rod connected to said motor;

a carrier, said carrier being threadably engaged to said threaded rod; and a linkage, said linkage being connected to said carrier and said back lever, whereby said motor turns said threaded rod, said threaded rod translates said carrier, said carrier moves said linkage, and said linkage operates said back lever in conjunction with said front lever.

4. A seat lift as recited in claim 2, further comprising, a limit switch mounted to automatically stop said drive unit.

5. A seat lift as recited in claim 1, further comprising, a spring mounted between one of said levers and said base, said spring having a bias to assist in the rotation of said front lever with said back lever.

6. A seat lift as recited in claim 1, further comprising, a handle attached to said base for carrying said seat lift.

7. A seat lift, comprising:

a base;

a seat having a front side;

a first lever being a single element having two ends, one of said two ends is rotationally mounted directly to said base at a fixed position and said other end of said first lever is rotationally mounted to said front side of said seat;

a second lever having two ends, one of said two ends is rotationally mounted to said base and said other end of said second lever is slidably mounted to said seat; and a means for proportionally rotating said first lever with said second lever.

* * * * *